US009523240B2

(12) United States Patent
Koch et al.

(10) Patent No.: US 9,523,240 B2
(45) Date of Patent: Dec. 20, 2016

(54) METHOD FOR PRODUCING A HORIZONTAL BORE IN THE GROUND AND HORIZONTAL DRILLING DEVICE

(75) Inventors: Elmar Koch, Eslohe (DE); Sebastian Fischer, Lennestadt (DE); Andreas Joachim Hanses, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 908 days.

(21) Appl. No.: 13/638,296

(22) PCT Filed: Mar. 31, 2011

(86) PCT No.: PCT/EP2011/001612

§ 371 (c)(1),
(2), (4) Date: Nov. 29, 2012

(87) PCT Pub. No.: WO2011/120692

PCT Pub. Date: Oct. 6, 2011

(65) Prior Publication Data

US 2013/0199851 A1 Aug. 8, 2013

(30) Foreign Application Priority Data

Mar. 31, 2010 (DE) ..... 10 2010 013 725

(51) Int. Cl.

| | |
|---|---|
| ***E21B 7/04*** | (2006.01) |
| ***E21B 49/06*** | (2006.01) |
| ***E21B 19/20*** | (2006.01) |
| ***E21B 7/30*** | (2006.01) |

(52) U.S. Cl.

CPC ..... *E21B 7/046* (2013.01); *E21B 7/30* (2013.01); *E21B 19/20* (2013.01); *E21B 49/06* (2013.01)

(58) Field of Classification Search

CPC ..... E21B 7/046; E21B 49/06; E21B 19/20; E21B 7/30

See application file for complete search history.

(56) References Cited

U.S. PATENT DOCUMENTS

| | | | | |
|---|---|---|---|---|
| 2,889,137 A | | 6/1959 | Walker | |
| 4,630,967 A | | 12/1986 | Soltau | |
| 4,691,788 A | * | 9/1987 | Yoshida | E21B 7/005 175/202 |

(Continued)

FOREIGN PATENT DOCUMENTS

| | | |
|---|---|---|
| DE | 196 33 934 A1 | 6/1999 |
| DE | 10159712 A1 | 1/2003 |

(Continued)

OTHER PUBLICATIONS

European Search Report dated Apr. 1, 2014 for EP Application No. EP 13005268, which is a divisional application of parallel European Application No. EP 2553201 A2.

*Primary Examiner* — Nicole Coy
(74) *Attorney, Agent, or Firm* — Howard IP Law Group

(57) ABSTRACT

A method for producing a horizontally drilled bore hole in the ground includes the steps of producing a pit having a circular cross-section; lowering a horizontal drilling device into the pit, the horizontal drilling device having a circular cross-section in at least part of the section in which it is positioned once it is lowered into the pit; and producing a horizontally drilled bore hole using the horizontal drilling device.

16 Claims, 11 Drawing Sheets

(56) References Cited

U.S. PATENT DOCUMENTS

| | | | | |
|---|---|---|---|---|
| 5,411,106 | A * | 5/1995 | Maissa | E21B 49/06 175/250 |
| 5,617,927 | A * | 4/1997 | Maissa | E21B 49/06 175/40 |
| 5,622,231 | A | 4/1997 | Thompson | |
| 6,050,351 | A * | 4/2000 | Eckenfels et al. | 175/62 |
| 6,086,050 | A | 7/2000 | Wiederkehr et al. | |
| 7,726,028 | B2 | 6/2010 | Koch et al. | |
| 7,824,130 | B2 | 11/2010 | Koch et al. | |
| 8,075,224 | B2 | 12/2011 | Koch et al. | |
| 2004/0188144 | A1 | 9/2004 | Volkel | |
| 2007/0151765 | A1 | 7/2007 | Billingsley | |
| 2011/0150577 | A1 | 6/2011 | Koch et al. | |
| 2011/0168286 | A1 | 7/2011 | Koch et al. | |
| 2011/0239434 | A1 | 10/2011 | Koch et al. | |

FOREIGN PATENT DOCUMENTS

| | | |
|---|---|---|
| DE | 38 03 070 C1 | 3/2009 |
| EP | 0 167 979 A1 | 1/1986 |
| EP | 0825326 A2 | 2/1998 |
| JP | 56016275 B2 | 4/1981 |

* cited by examiner

METHOD FOR PRODUCING A HORIZONTAL BORE IN THE GROUND AND HORIZONTAL DRILLING DEVICE

CROSS-REFERENCES TO RELATED APPLICATIONS

This application is the U.S. National Stage of International Application No. PCT/EP2011/001612, filed Mar. 31, 2012, which designated the United States and has been published as International Publication No. WO 2011/120692 and which claims the priority of German Patent Application, Serial No. 10 2010 013 725.1, filed Mar. 31, 2010, pursuant to 35 U.S.C. 119(a)-(d).

BACKGROUND OF THE INVENTION

The invention relates to a method for producing a horizontal bore in the ground and a horizontal drilling device for use in such a method.

Horizontal drilling devices are used to introduce supply and disposal lines into the ground in trenchless construction or to exchange already installed old lines in a trenchless manner.

There are many different horizontal drilling devices. Common are horizontal drilling devices in which a drill head is initially advanced angled into the ground by means of a drill rod assembly and starting from a drill boom positioned above ground until the drill head has reached the desired drilling depth. Then, the drill head is redirected into the horizontal position in order to carry out the horizontal drilling. The target point of such a horizontal drilling can for example be located in a target excavation pit which is excavated for this particular purpose or in a basement room or it can also be located above ground i.e., like the starting point, so that the drill head after a defined drilling progress is redirected into a diagonally upwards pointing direction, to let the drill head reemerge above ground.

After the drill head has reached the target point, it is often replaced for a widening device for example a conical widening body, to widen the previously generated (pilot) bore by means of the drill boom when retracting the drill rod assembly. This may involve attaching a new line to be drawn into the widening device, to draw the new line into the ground simultaneous with the widening of the pilot bore.

Horizontal drilling devices are also used to replace old lines in the ground in a trenchless manner. For this, in a first step the drill rod assembly is pushed by the drill boom along the old line (and in particular through an old line) and after reaching a target point, which can be located in a maintenance shaft of the sewage system, the front end of the drill rod assembly is connected with a widening device by which the old line is cut or burst when retracting the drill rod assembly, wherein the fragments of the destroyed old line are radially displaced into the soil. At the same time, a new pipe can be drawn into the old pipe. Destroying the old pipe an displacing the fragments of the old pipe allows the new pipe to have an outer diameter which corresponds to the outer diameter of the old pipe or even exceeds this diameter.

As an alternative, an adapter can be connected to the front end of the drill rod assembly which adapter engages on the rear end of the old pipe and pulls the old pipe out of the ground when retracting the drill rod assembly. This allows avoiding that fragments of a destroyed old pipe remain in the ground which may otherwise cause damage to the new pipe due to sharp-edged brakeage edges and the pressure exerted by the surrounding soil.

Horizontal drilling devices usually have a linear drive with which the drill rod assembly can be advanced and retracted within the ground. Further, a rotational drive is usually provided with which the drill rod assembly (and with this the drill head and widening head connected thereto) can be rotated. The rotation of the drill head or the widening device allows improving the advance in the soil.

Further, most of the steerable horizontal drilling devices require a rotation of the drill head to steer the drill head into a desired drilling direction. The drill heads of such horizontal drilling devices have an asymmetrically formed (for example slanted) drill head front, which leads to a lateral deflection of the drill head during movement of the drill head through the soil. When the drill head is simultaneously rotatingly driven when being advanced in the soil, the asymmetric configuration of the drill head has no influence on the straight drilling course, because the lateral deflection evens out over a rotation. On the other hand, when the rotation of the drill head is stopped and the drill head is exclusively advanced by pushing—optionally supported by strokes of a stroke device which is integrated in the drill head or in the drill boom—the asymmetric configuration of the drill head leads to a (constant) lateral deflection. This achieves an arched drilling course and as a result a change of the drilling direction.

Horizontal drilling devices which are exclusively intended for replacing old pipes which are already installed in the ground often have no additional rotational drive.

Horizontal drilling devices in which the drill boom is intended for positioning above ground, often can only be used in non-urban areas because the horizontal drilling devices have to be positioned at a considerable distance to the region in which the bore or the new line is to be introduced into the ground or in which an already existing old pipe is to be exchanged, due to the drilling distance required to reach the desired drilling depth. Oftentimes, corresponding space requirements are not available in built-up areas. A further disadvantage of such horizontal drilling devices is that these drilling devices which are commonly configured as self-propelled drill boom, cause significant crop damage which has to be remedied by a corresponding financial effort.

Because of these disadvantages, the trenchless line construction in built-up areas is still largely limited to the trenchless replacement of old pipes because the old pipes always extend between subterranean hollow spaces (in particular supply shafts and basement rooms) which are already present and which can be used for the positioning of the horizontal drilling device. Excavation work and as a result, crop damage can thus mostly be prevented. For this, horizontal drilling devices have been developed which are configured so that they can be positioned in a supply shaft or sewage system. Because new supply lines often are not to be installed along existing supply routes these horizontal drilling devices are often not available for newly installing supply lines.

From IDE 196 33 934 A1 a horizontal drilling device is known which is configured for use in small excavation pits with a square cross section of about 70 cm×40 cm and a depth of about 1 m to 1.5 m. These horizontal drilling devices include a frame whose dimensions roughly correspond to the cross sectional dimensions of the excavation pit and are lowered into the excavation pit. A part of the frame protrudes over the upper edge of the excavation pit. In the section of the frame which is located inside the excavation pit a combined linear/rotary drive is provided via which a drill rod assembly which is composed of individual rod assembly sections is advanced into the soil. The rod assembly sections which are successively screwed to the rear end of the already drilled drill rod assembly are supplied to the linear/rotational drive via a rod assembly lift which transports the rod assembly sections from a rod assembly magazine which is arranged in the upper section of the frame which protrudes over the edge of the excavation pit, to the linear/rotational drive.

The horizontal drilling device known from DE 196 33 934 A1 enables introducing bores into the ground starting from any desired starting position. Because only a relatively small excavation pit is required for the positioning of the horizontal drilling device and the horizontal drilling device can also be transported easily owing to the compact design, its use is associated with relatively small crop damages.

A disadvantage of the horizontal drilling device known from DE 196 33 934 A1 is that for this horizontal drilling device an exact orientation of the excavation pit to be excavated is required because the direction in which the bore is initiated starting from the horizontal drilling device, is essentially perpendicular to the two narrow sides of the excavation pit. In addition, only two bores in opposite directions can be carried out based on one excavation pit, namely in the two directions which are perpendicular to the two narrow sides of the excavation pit. Drilling in the two directions requires lifting the entire horizontal drilling device out of the excavation pit, turning it by 180° about the vertical axis and then lowering it again into the excavation pit.

Proceeding from this state of the art, the invention is based on the object to provide an improved horizontal drilling device. Further, an improved method for introducing a bore into the ground was to be provided. In particular, a method and a corresponding horizontal drilling device was to be provided which, based on a relatively small excavation pit, allows flexibly introducing horizontal bores into the ground.

SUMMARY OF THE INVENTION

This object is solved by the subject matters of the independent claims. Advantageous refinements of the method according to the invention or the horizontal drilling device according to the invention are the subject matter of the respective dependent patent claims and result from the following description of the invention.

The idea on which the invention is based is to provide a horizontal drilling device which has a circular cross section and to insert the horizontal drilling device into an excavation pit which also has a circular cross section with preferably the same diameter. The preferably cylindrical shape of the excavation pit and the horizontal drilling device arranged therein allows rotating the horizontal drilling device in the excavation pit about the vertical axis and thus accurately orienting the horizontal drilling device in the desired drilling direction. A lifting of the horizontal drilling device out of the excavation pit is not required. There are thus no special demands on the orientation of the excavation pit in the ground owing to the circular cross section. Due to the fact that the excavation pit and the section of the horizontal drilling device which is located in the excavation pit each have a circular cross section with mostly identical diameter, the volume of the excavation pit to be excavated can be reduced to the required minimum. A cylindrical shape of the horizontal drilling device and the wall of the excavation pit surrounding the latter can be supported on a particularly large surface within the excavation pit independent of the respective rotative orientation of the horizontal drilling device in the excavation pit.

A method according to the invention for generating a horizontal bore in the ground has therefore the following steps:

a. generating an excavation pit with a circular cross section;
b. lowering a horizontal drilling device into the excavation pit, wherein the horizontal drilling device at least partially has a circular cross section at least in the section in which the horizontal drilling device is arranged in the excavation pit after lowering into the excavation pit;
c. generating the horizontal bore by using the ground drilling device.

The horizontal bore can be generated in any desired manner, i.e., in particular by advancing or retracting a drill rod assembly at which a drill head or a widening device can be arranged front side, wherein for example either a (pilot) bore is introduced into the ground, an existing old line is destroyed and/or replaced by a new line, or a new line is drawn into a bore.

It is noted that according to the invention "establishing" or "generating a horizontal bore in the ground" relates to all previously mentioned methods of the trenchless line rehabilitation and therefore not only to generating a (pilot) bore per se, but also to the widening of a bore, the drawing in of a new line into a bore and the bursting or pulling out of an old line.

A horizontal drilling device according to the invention, in particular for use in a method according to the invention, has at least one linear drive and a drill rod assembly which is drivable into or retractable out of the ground by the linear drive. According to the invention, a housing is also provided which largely or completely surrounds the linear drive and which, in at least the section in which it is arranged within an excavation pit (pit section) in the operating condition of the horizontal drilling device, i.e. when the linear drive pulls the drill rod assembly into the ground or retracts the drill rod assembly out of the ground, has at least in parts a circular section and is in particular configured cylindrical.

The housing of the horizontal drilling device is preferably dimensioned so that the latter defines the dimensions of the horizontal drilling device in at least the pit section. According to the invention, this means that the housing surrounds the remaining components of a horizontal drilling device such as in particular the linear drive and optionally a rotational drive and is intended for resting against a wall of an excavation pit in order to support the forces generated by the horizontal drilling device in the ground. Such a housing can for example be configured open or closed. An open housing can for example be formed by a scaffold or frame.

The method according to the invention allows in a simple manner to generate horizontal bores also out of excavation pits with very small dimensions and in particular out of such excavation pits within which no operating personnel can be present for operating the horizontal drilling device. In particular, the method according to the invention is useful for generating horizontal bores in the ground out of excavation pits which have a maximal diameter of about 85 cm and in particular about 60 cm but also smaller. A diameter of about 60 cm may resemble a good compromise because on one hand the size of the excavation pit is relatively small and as a result crop damages are limited, at the same time however, sufficient space remains within the housing of the horizontal drilling device for arranging a sufficiently powerful linear and/or rotational drive. At diameters of the excavation pit of greater than 85 cm the effort for producing an excavation pit with a circular cross section can become so great that the latter cannot be compensated by the advantages of the method according to the invention.

An excavation pit with a circular cross section cannot—or only with great effort—be produced by means of a conventional excavator or manually. This is in particularly true for small excavation pits with diameters of up to about 60 cm, which according to the invention are preferred. In a preferred embodiment of the method according to the invention, the excavation pit can be produced in that the surface seal (as far as present) such as for example tar or asphalt cover is drilled open with a crown drill and the underlying soil is sucked away with a conventional suction dredger. In this way cylindrical (more or less geometrically accurate) bores can be introduced into the ground.

Preferably, the housing forms a substantially closed sheath in the pit section of the horizontal drilling device according to the invention. This allows largely preventing the soil from falling into the interior of the housing and contaminating functional elements arranged there, such as in particular the linear and rotational drive etc. In addition, a substantially closed sheath can achieve a large support surface which allows increasing the stability of the horizontal drilling device in the excavation pit.

A "substantially closed sheath" means a sheath which covers a large part of the corresponding section of the housing and has in particular only recesses or openings which are required for the functioning of the drilling device. Such a recess or opening is for example required for the through-passage of the drill rod assembly.

In order to improve the positioning and support of the horizontal drilling device within the excavation pit, at least one support element can be provided which is drivable radially outward—past the outer circumference of the housing—in order to ensure a support of the horizontal drilling device against the wall which is as free of play as possible. The support element can thus be driven radially outward from a retracted position in which it is arranged within the dimensions defined by the housing, in order to securely position the horizontal drilling device in an excavation pit.

Particularly preferably, more than one support element and in particular at least two, four or five support elements are provided which are arranged spaced apart in defined, preferably even distribution relative to one another and can preferably be extended independent of one another. By individually extending multiple support elements, the horizontal drilling device can not only be securely supported in the excavation pit but also simultaneously oriented in its position (orientation of the longitudinal axis of the housing; corresponds in operating position to the vertical axis of the horizontal drilling device).

In a further preferred embodiment, the support element can have a support plate which forms a part of the sheath. On one hand this allows achieving that the horizontal drilling device forms a largely closed cylindrical sheath in the corresponding section, when the support element or the support elements are positioned in a retracted position; on the other hand, the support plate as section of the sheath has an arched shaped which is similar in its radius to the radius of the arch-shaped wall of the excavation pit so that an even and secure support can be achieved, when the support element is extended radially.

Further, a horizontal drilling device according to the invention can have a section (surface section) which is located above the excavation pit in operating condition. In this section of the horizontal drilling device, in particular the functional elements can be located which are intended to be accessible by operating personnel to operate the horizontal drilling device.

The surface section of the horizontal drilling device can further have a support device via which the horizontal drilling device is supported at the ground surface. Via the support device the horizontal drilling device can thus be suspensory supported within the excavation pit.

Particularly preferably, this support device can be configured adjustable to enable a height adjustment of the horizontal drilling device in the excavation pit. By this, a simple and flexible (because easily adjustable) height positioning of the horizontal drilling device according to the invention (or the pit section of the horizontal drilling device) within the excavation pit can be achieved. In addition it is avoided that an appropriate bottom of the excavation pit i.e., an even bottom which is oriented in the right angle relative to the horizontal direction, has to be provided. This allows reducing the effort for introducing the excavation pit.

Because the cylindrical excavation pit as well as the correspondingly dimensioned horizontal drilling device preferably have a small diameter, it may be required to successively supply the linear drive, which is located within the pit section of the horizontal drilling device, with rod assembly sections from the ground surface, which rod assembly sections are then interconnected to form the drill rod assembly. For this, the horizontal drilling device according to the invention can preferably be provided with a rod assembly lift which transports a rod assembly section of the drill rod assembly between the surface section and the pit section. This can occur in both directions i.e., during generating of a (pilot) bore, the rod assembly sections are transported one after another from the surface section to the linear drive within the pit section of the horizontal drilling device, while during retraction of the drill rod assembly from an already generated bore, for example when the latter is widened and/or a new line is drawn in, the individual rod assembly sections which are released from the drill rod assembly are transported by means of the rod assembly lift from the linear drive to the surface section where the rod assembly sections can be retrieved either by operating personnel or by an automated rod assembly transfer.

Further preferably, the rod assembly lift can have a rod assembly receiver in which a rod assembly section is laterally insertable. Such a rod assembly receiver enables a simple accessibility from the side by operating personnel and ensures a secure grip during the transport of the rod assembly section (along a vertically oriented rod assembly lift).

When rod assembly sections are used, which are configured at least partially hollow, a transfer of the rod assembly section from the rod assembly lift to the linear drive can preferably occur by means of a receiving mandrel which is arranged so that the rod assembly section can be directly attached by the rod assembly lift after reaching the target position of the rod assembly receiver.

The rod assembly sections preferably have a length which is shorter only as little as possible than the diameter of the housing in the pit section of the horizontal drilling device. By using rod assembly, sections which are as long as possible, the effort which is required for joining or releasing the individual rod assembly sections of the drill rod assembly can be reduced to a minimum. For reasons of space however, it may be necessary or useful to transport the relatively long rod assembly sections in the rod assembly lift in a vertical orientation. In this case, the receiving mandrel can be configured pivotal to enable the attachment of the rod assembly section which is transported by the rod assembly lift also in a substantially vertical orientation. After attachment of the rod assembly section the receiving mandrel can then be pivoted into a substantially horizontal orientation which corresponds to the direction of drilling.

BRIEF DESCRIPTION OF THE DRAWING

In the following, the invention is explained in more detail by way of an exemplary embodiment shown in the drawings.

In the drawings it is shown in.

DETAILED DESCRIPTION OF PREFERRED EMBODIMENTS

Figure 1:
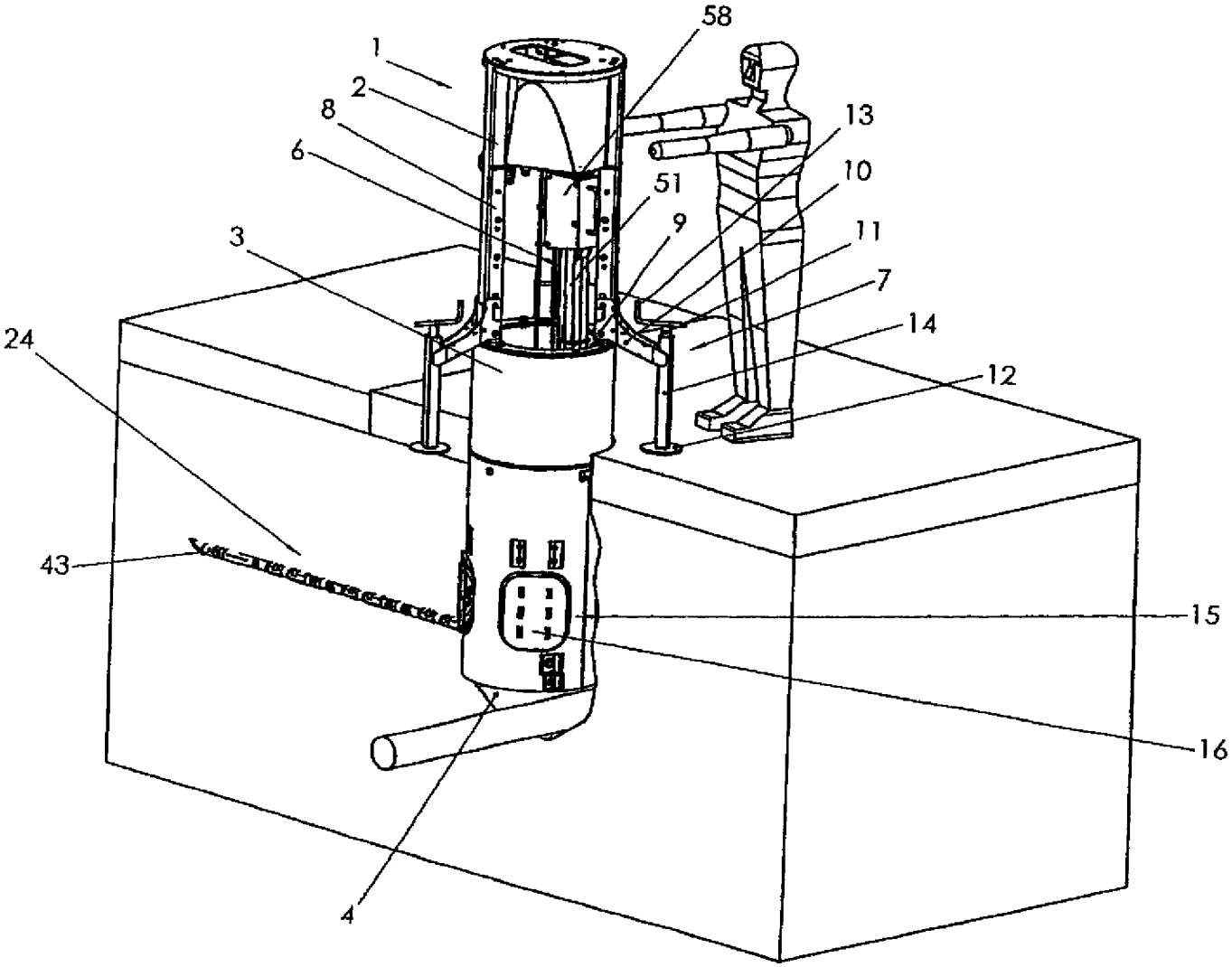
FIG. 1 a horizontal drilling device according to the invention in a perspective view.

FIG. 1 shows in an isometric view a horizontal drilling device according to the invention 1 during the introduction of a pilot bore into the soil.

The horizontal drilling device includes a cylindrical housing 2, which is partially closed via a cylindrical sheath 3. Functionally, the horizontal drilling device 1 or respectively, the housing 2 of the horizontal drilling device 1 is divided into two sections, namely a lower section referred to as "pit section", which is located within an excavation pit 4 which was excavated especially for receiving the horizontal drilling device 1. In the pit section of the horizontal drilling device 1 the housing 2 is essentially completely closed by the sheath 3. This prevents that soil which becomes dislodged from the walling of the excavation pit 4 falls into the hollow space which is formed in the housing 2 where further functional elements of the horizontal drilling device 1 and in particular a combined linear/rotational drive 5 are located. Soil which falls into the hollow space might otherwise contaminate these functional elements thereby impairing the function of the horizontal drilling device 1.

In the upper section of the horizontal drilling device 1 according to the invention, also referred to as "surface section", the housing 2 is partially configured open in order to provide access for operating personnel to a rod assembly lift 6 which extends as far as into this region.

The horizontal drilling device 1 is positioned "suspended" within the excavation pit i.e., the horizontal drilling device 1 is supported not on the floor of the excavation pit 4, but rather via a support device with a total of three support legs 7 which are fastened in the region of the surface section of the horizontal drilling device 1 on longitudinal supports 8 of the housing 2. Each of the support legs 7 can be fastened to a total of five different points on the respective longitudinal support 8. This allows for a height adjustment of the horizontal drilling device 1 which is suspended in the excavation pit 4. This height adjustment is important, for example for positioning the linear/rotational drive 5 which is located in the pit section, at the correct height for introducing the pilot bore into the soil. A fixing of the support legs 7 at the different points along the longitudinal supports 8 occurs via a respective transverse bolt 9, which is inserted through a through-bore in a transverse support 10 of the respective support leg 7 and the respective longitudinal support 8 of the housing 2, and is then fixed.

Each of the support legs 7 further has a spindle support which is connected to the transverse support 10 of the respective support leg 7 via a pivot joint. The spindle support includes a threaded rod 11 which has a support foot 12 on its foot end. A handle 13 is provided on the end of the threaded rod 11 which is opposite the support foot 12 via which handle 13 the threaded rod 11 can be rotated about its longitudinal axis, thereby achieving a longitudinal displacement relative to the spindle housing 14 which surrounds the threaded rod. The spindle supports serve for accurately orienting the horizontal drilling device 1 within the excavation pit 4 after a first height adjustment was already achieved by the fastening of the support legs 7 on the longitudinal supports 8 of the housing 2.

It can be recognized in FIG. 1 that the excavation pit 4—like the housing 2 of the horizontal drilling device 1—has a (substantially) cylindrical shape whose inner diameter essentially corresponds to the outer diameter of the housing 2 of the horizontal drilling device 1. The sheath 3 of the horizontal drilling device 1 in the region of the pit section rests thus more or less directly against the wall of the excavation pit 4. The fact that the inner diameter of the excavation pit and the outer diameter of the housing largely correspond to one another not only allows limiting the size of the excavation pit to be excavated to a minimum but also to achieve a most even support of the horizontal drilling device on a largest possible surface within the excavation pit 4. The circular cross section of the excavation pit 4 and the housing further render the support independent of the respective rotational orientation (about the longitudinal axis of the horizontal drilling device).

The excavation pit 4 was excavated by first introducing a ring-shaped groove having the required (outer) diameter into the surface sealing (asphalt cover) with a core drill (not shown), removing the thus exposed disc-shaped asphalt cover and subsequently sucking away the soil located underneath with a suction dredger (not shown). The suction dredger which was used for this purpose includes a suction nozzle which also has a circular cross section. The excavation pit 4 is excavated somewhat deeper than necessary to allow for height adjustment of the suspensory supported horizontal drilling device 1 inside the excavation pit 4, without causing an unintended touch down of the lower end of the horizontal drilling device 1 onto the pit bottom.

After excavation of the excavation pit 4, the horizontal drilling device 1 was lowered into the excavation pit 4 by means of a crane (not shown) until the support legs 7 which where previously fastened to the longitudinal supports 8 of the housing 2 come into contact with the ground surface. The horizontal drilling device 1 was then rotatively oriented by means of the crane within the excavation pit 4 by rotating the horizontal drilling device 1 about its longitudinal axis until the bore axis which is defined by the linear/rotational drive which is arranged inside the pit section of the horizontal drilling device 1 points into the desired starting direction for the pilot bore. A fine adjustment of the working height of the horizontal drilling device 1, and to a limited degree also the tilt of the horizontal drilling device 1 relative to the vertical, was then achieved via the spindle supports.

Because the wall of the excavation pit 4—in particular in the case when it was excavated by means of a suction dredger—commonly is not configured evenly cylindrical, the horizontal drilling device 1 according to the invention has overall four support elements 15 in the region of the pit section which are evenly distributed across the circumference. These support elements 15 include support plates 16 which in a retracted position each form a section of the cylindrical sheath 3 of the horizontal drilling device. The support plates 16 can each be extended outward in radial direction by means of a hydraulic cylinder 17 to generate a direct contact of the horizontal drilling device 1 with the wall of the excavation pit 4 to securely support the horizontal drilling device 1 inside the excavation pit 4.

Figure 3:
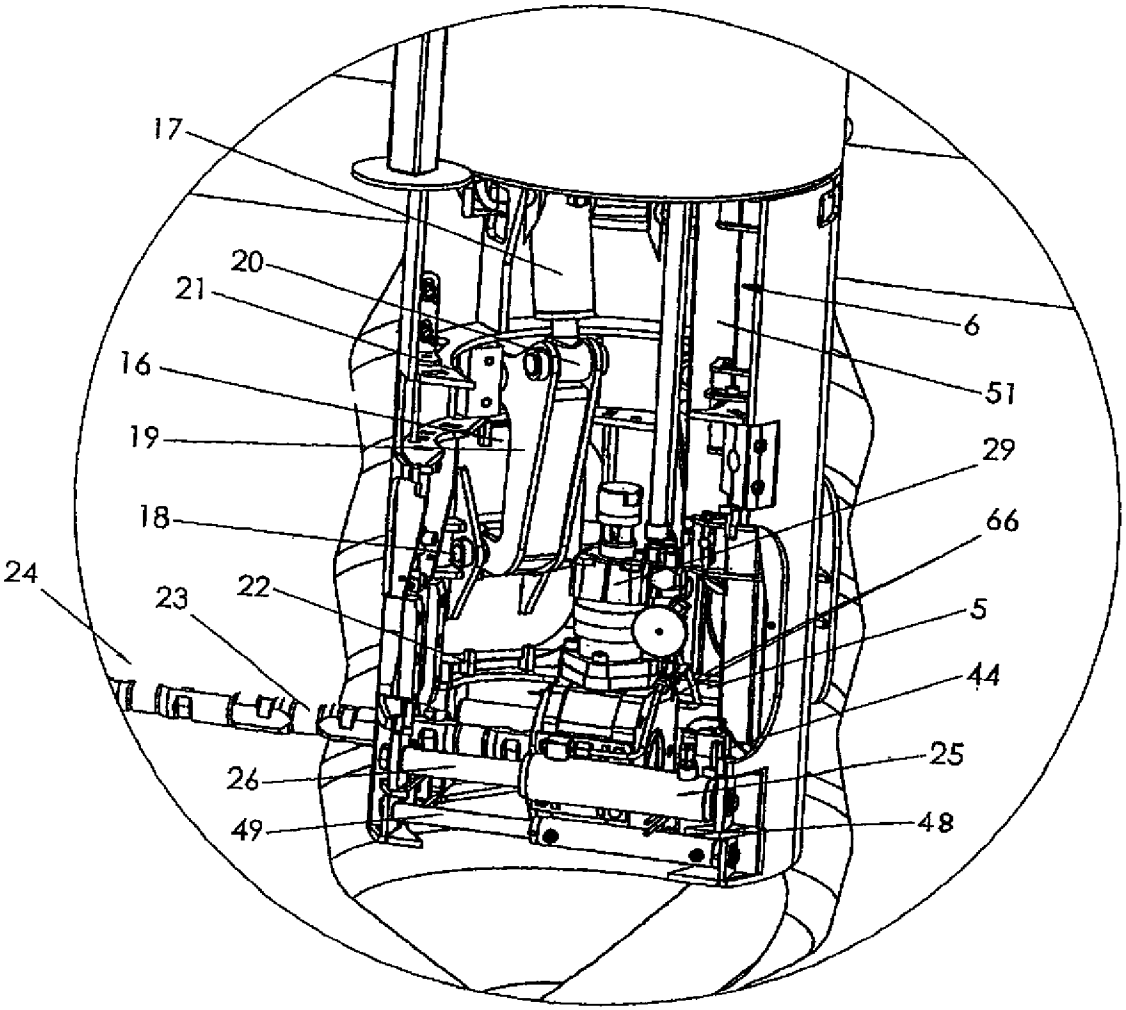
FIG. 3 an enlarged section of the representation according to FIG. 2.

The individual components of these support elements 15 are well recognizable in FIG. 3. Each of the support plates 16 is connected to a first end of an extension lever 19 via a first pivot joint 18, with the extension lever 19 being in turn rotatingly supported on the housing 2 of the horizontal drilling device 1 by means of a second pivot joint 21. A second end of the extension lever 19 is connected to the head of a piston rod 20 of the hydraulic cylinder 17. An extension or retraction of the hydraulic cylinder 17 thus causes a partial rotation of the extension lever 19 about the pivot joint 21, whereby the respective support plate 16 can be radially extended or retracted again. End stops 22 prevent that the support plate 16 enters the inner space defined by the sheath of the housing when retracting the hydraulic cylinder 17.

Figure 2:
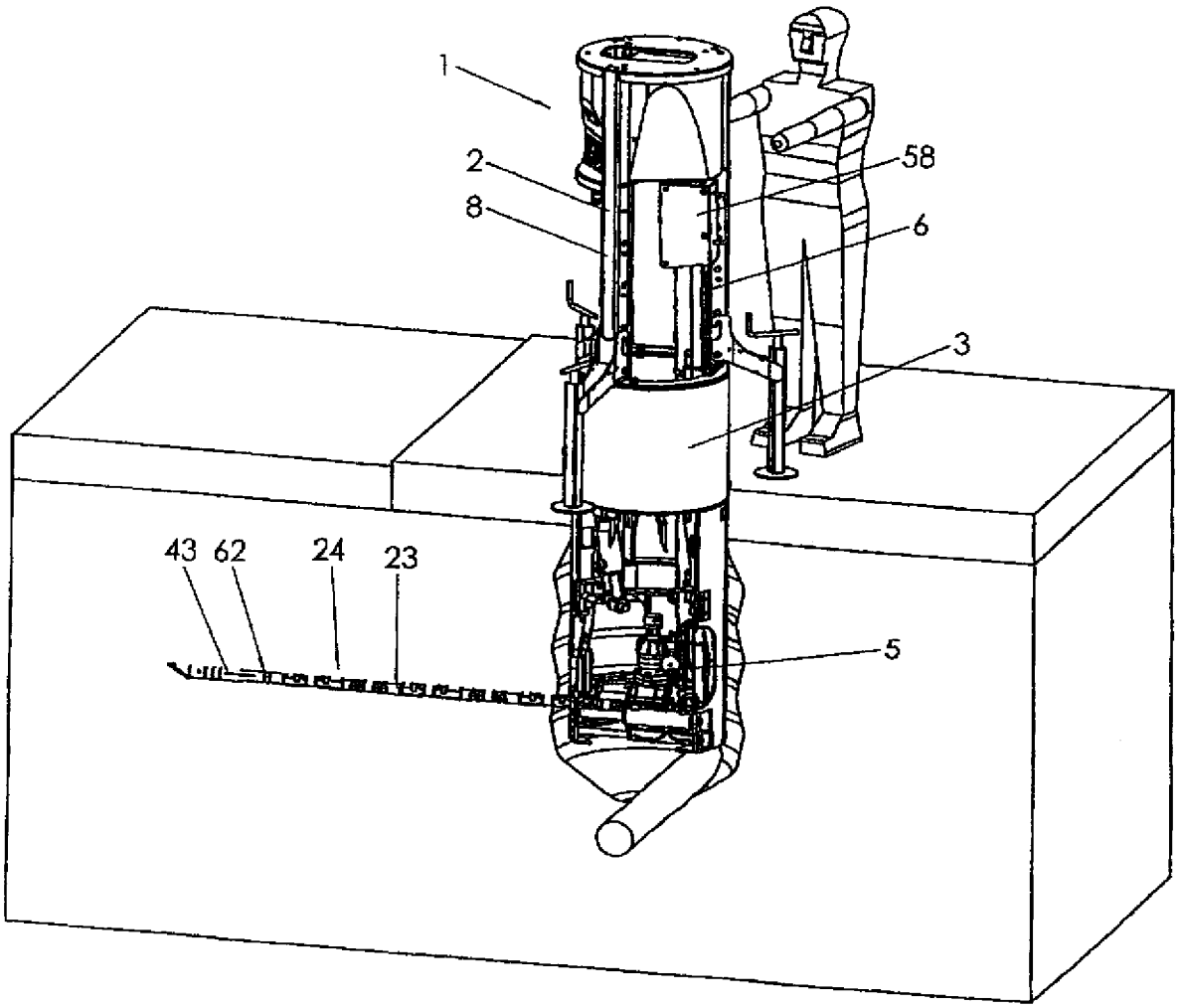
FIG. 2 the horizontal drilling device of FIG. 1 in a second perspective view.

FIG. 2 shows a representation of the entire horizontal drilling device 1 which corresponds to the representation of FIG. 1 in which, however, a part of the sheath 3 in the excavation pit is removed to show the functional elements arranged therein.

Figure 4:
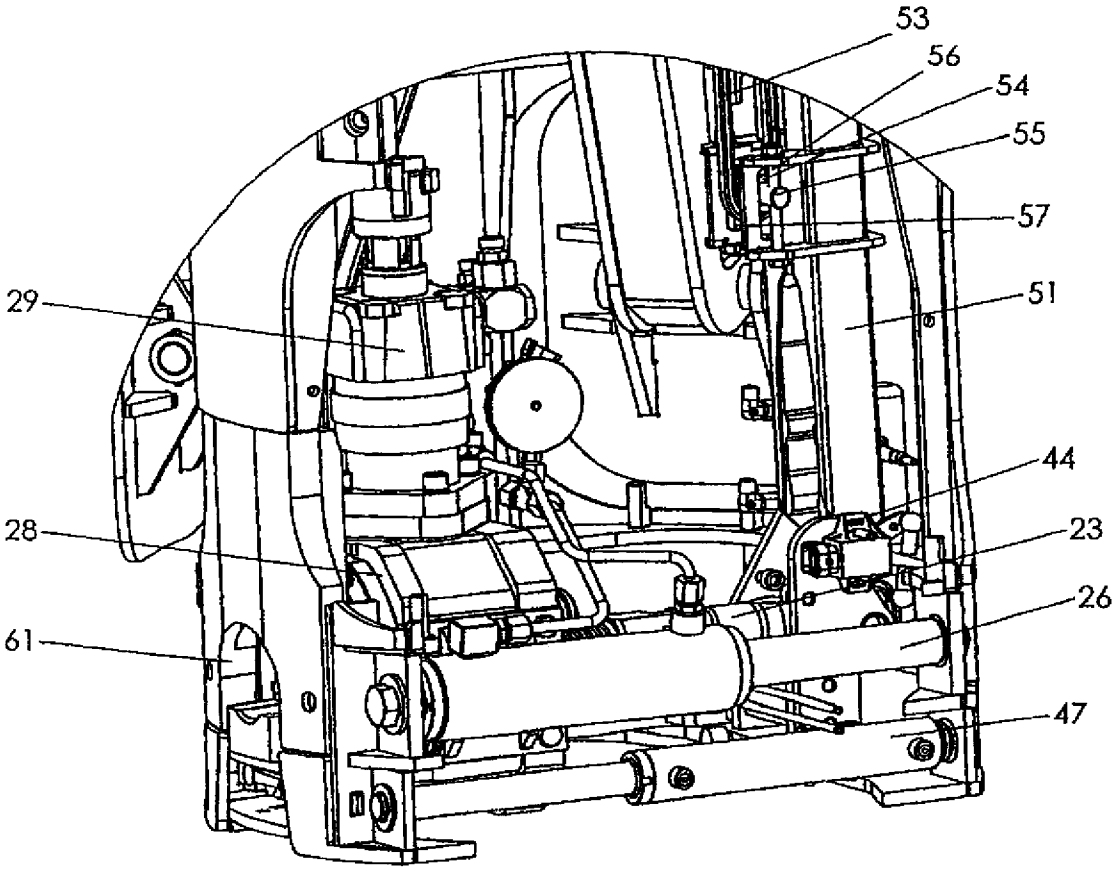
FIG. 4 the lower section of the horizontal drilling device according to FIGS. 1 to 3 in a perspective view.
Figure 5:
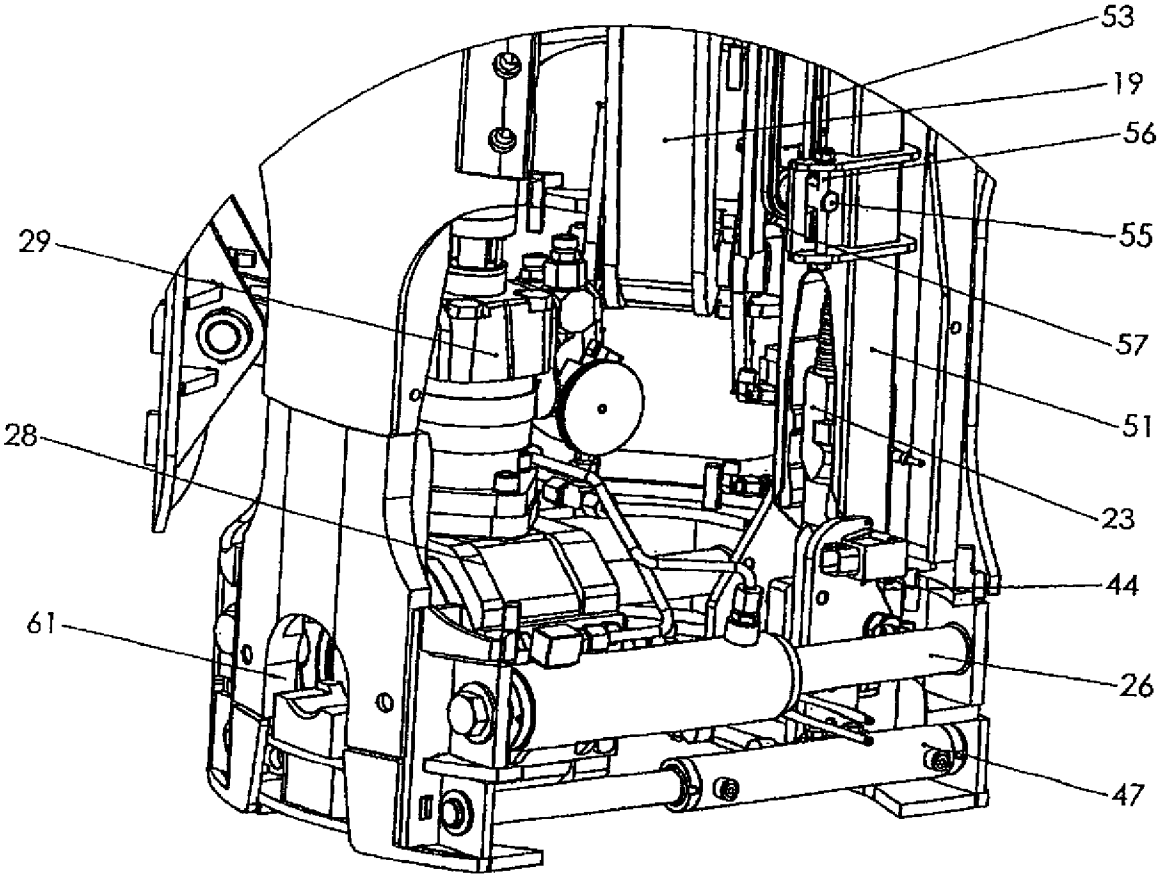
FIG. 5 the representation according to FIG. 4 in another operating position of the horizontal drilling device.

FIGS. 3 to 5 show different views of this section of the horizontal drilling device 1 in enlarged representations. It can be seen that the combined linear/rotational drive 5 at the lower end of the horizontal drilling device 1 is arranged within the housing 2. The linear/rotary drive 5 serves for rotatingly advancing a drill rod assembly which is composed of individual rod assembly sections 23, into the ground.

Figure 6:
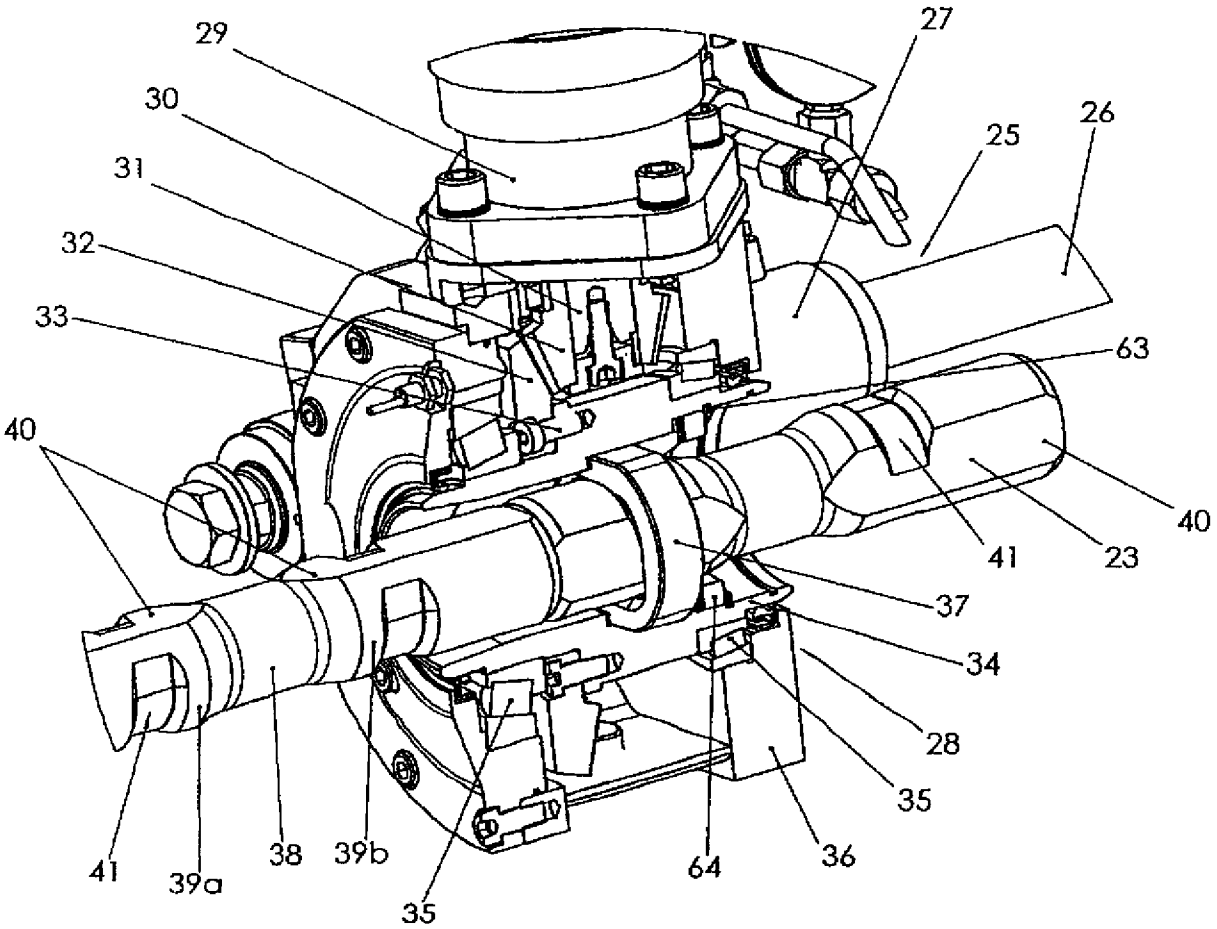
FIG. 6 an isolated representation of the rotational drive of the horizontal drilling device in a perspective view.

FIG. 6 shows a partial section through the linear/rotational drive 5 in a representation in which the linear/rotational drive 5 is isolated from the remaining elements of the horizontal drilling device 1. The linear/rotational drive 5 is formed by two hydraulic cylinders 25. The piston rods 26 of the two hydraulic cylinders 25 traverse the respective cylinder tube 27 completely and are connected with their two ends to the housing 2 of the horizontal drilling device 1. The piston rods 26 each have a centrally arranged piston (not shown) which divides the ring space which is respectively formed between the cylinder tube 27 and the piston rod 26, into two working chambers, which can each be supplied with hydraulic oil via a hydraulic line 66. Depending on the pressure of the hydraulic oil which is supplied to the individual working chambers, a movement of the respective cylinder tube 27 on the piston rod 26 in one or the other direction is achieved. The movement of the two hydraulic cylinders 25 of the linear drive is synchronized.

A rotational drive is arranged between the two cylinder tubes 27 of the hydraulic cylinders 25 which form the linear dive, and fastened to the two cylinder tubes 27. The rotational drive includes a motor 29 (in particular a hydraulic or electromotor) which is flange-mounted to a hollow gear 28. A drive shaft 30 of the motor 29 is connected with a differential gear wheel 31, which in turn meshes with a gear ring 32 which in turn is connected to a drive sleeve 34 via screw connections 33. The drive sleeve 34 is rotatingly supported within a housing 36 of the hollow gear 28 via two rolling bearings 35. A rotation of the drive shaft 30 of the motor 29 thus causes a rotation of the drive sleeve 34 about its longitudinal axis. This longitudinal axis corresponds essentially to the drill rod assembly 24 held therein and therefore also the drilling axis i.e., the starting direction of a pilot bore to be introduced or the longitudinal axis of a bore or an old pipe extending in the wall of the excavation pit 4.

For transmitting the rotational movement of the drive shaft 34 and the longitudinal movement which is generated by the hydraulic cylinders 25 of the linear drive to the drill rod assembly 24 which is held in the drive sleeve 34, a catch ring 37 is used which—in an operating position of the drill rod assembly 24 within the catch ring 37—fixes the drill rod assembly 24 in a form fitting manner. The catch ring 37 is form fittingly supported within the drive sleeve 34 and can be easily exchanged in case of wear, by first removing a retaining ring 63 from a corresponding groove in the inside of the drive sleeve 34 and then pulling out a spacer ring 64 from the drive sleeve. The catch ring 37 can then be easily pulled out of the drive sleeve 34.

Figure 9B:
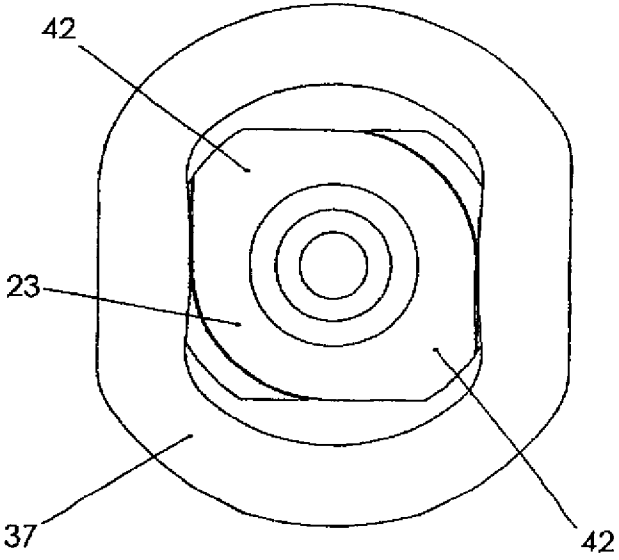
FIG. 9*b* a front view of the catch ring and the rod assembly section shown in FIG. 9*a;*
Figure 9A:
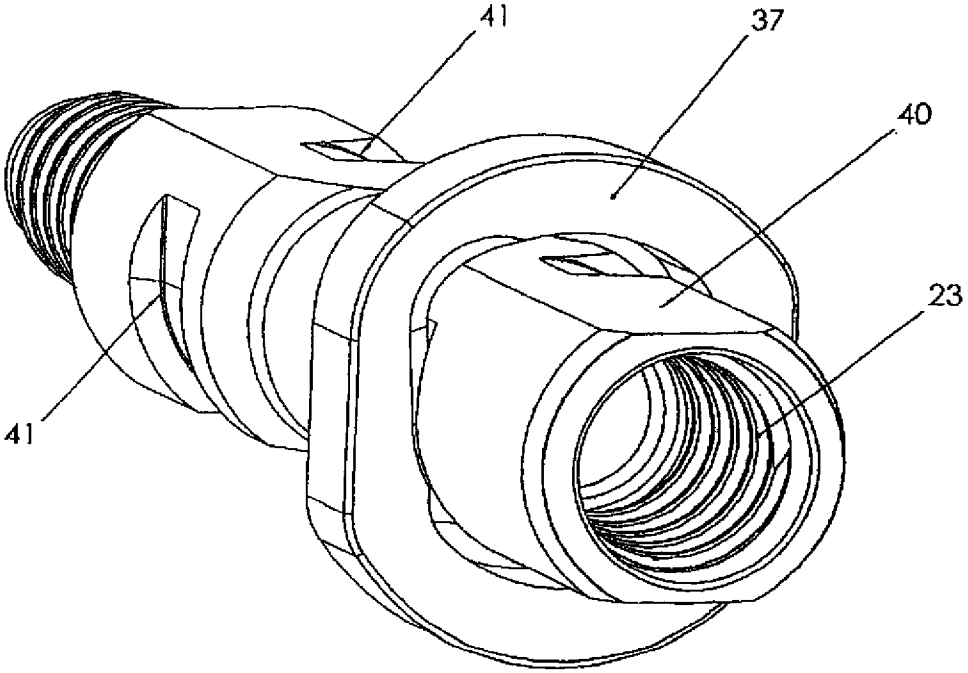
FIG. 9*a* an isolated representation of the catch ring of the rotational drive including a rod assembly section in a first operating position in an isometric view.

FIGS. 9*a* and 9*b* as well as 10*a* and 10*b* each show two views of the two operating positions of the drill rod assembly 24 within the catch ring 37 which are relevant for the operation of the horizontal drilling device 1. These two operating positions differ in a 90° relative rotation of the catch ring 37 about its longitudinal axis relative to the drill rod assembly 24. In the operating position shown in FIGS. 9*a* and 9*b* the drill rod assembly 24 is locked in the catch ring. This locking is achieved by the particular sheath shape of the rod assembly sections 23 of the drill rod assembly 24, and a shape of the central opening of the catch ring 37 which is adjusted thereto.

Figure 10B:
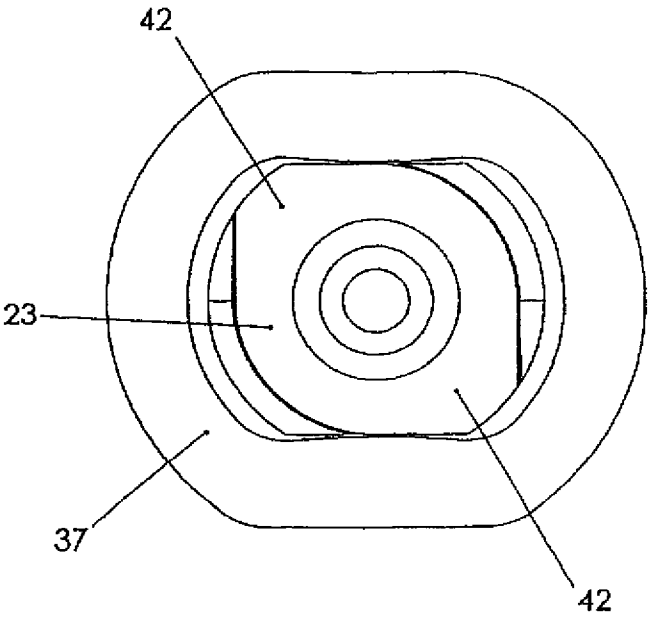
FIG. 10*b* a front view of the catch ring and the rod assembly section shown in FIG. 10*a*.
Figure 10A:
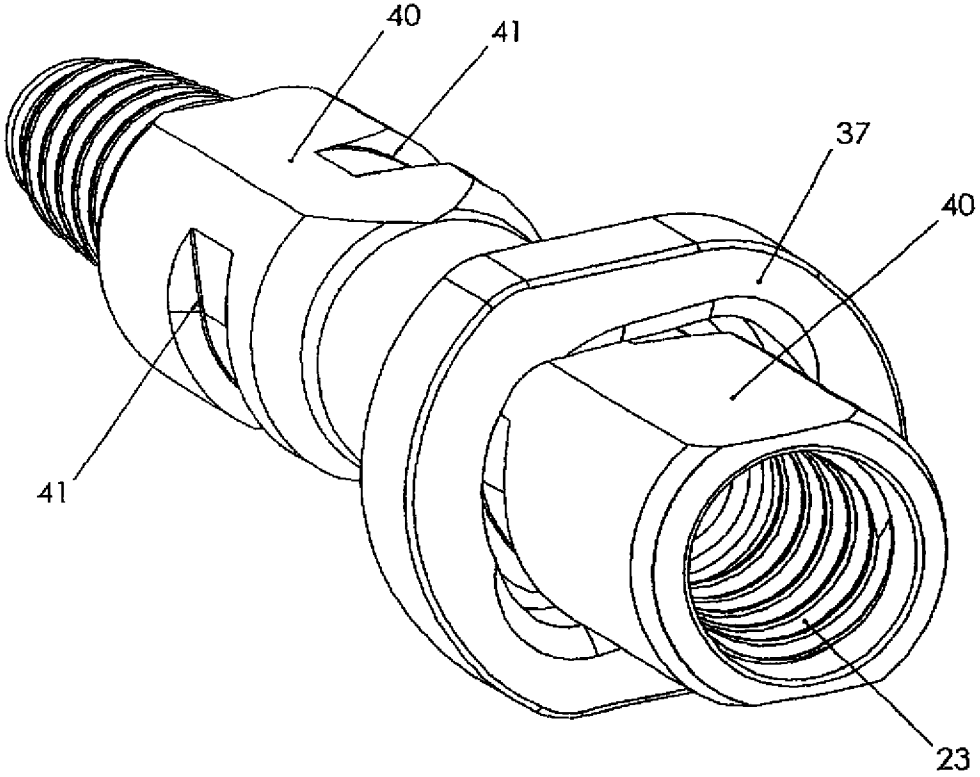
FIG. 10*a* an isolated representation of the catch ring of the rotational drive including a rod assembly section in a second operating position in an isometric view.

Each rod assembly section 23 of the drill rod assembly 24 has a cylindrical basic shape with a middle section 38 with a relatively small diameter and two end sections 39*a*, 39*b*, with a relatively large diameter. In each of the end sections 39*a*, 39*b* of a rod assembly section 23 two parallel flat portions 40 are provided, thereby resulting in a cross section with two parallel straight sides and two opposing arched-shaped sides. The catch ring 37 forms a through-opening which corresponds to this cross section so that it is possible to insert the rod assembly section 23 into the through opening of the catch ring 37 and to freely move it (in longitudinal direction) therein, when the catch ring 37 and the rod assembly sections 23 guided therein are arranged in the rotational orientation relative to one another shown in FIGS. 10*a* and 10*b*.

For locking the rod assembly section 23 in the catch ring 37, the catch ring 37 is moved inside the through-opening until two arched-shaped locking grooves 41 which are formed in each of the end sections 39*a*, 39*b* of the rod assembly section 23, are located within the catch ring 37. These locking grooves enable a relative clockwise rotation of the catch ring 37 by 90° into the operating position shown in FIGS. 9*a* and 9*b* (locking position). A rotation by more than 90° is also prevented by the fact that the two locking grooves 41 which are arranged offset to one another by 180° about the longitudinal axis of the rod assembly section 23, are only arch-shaped within an angular section of 90° and then extend straight. As a result of this, two cams 42 are formed whose distance is greater than the narrow width (corresponds to the two straight edges of the through-opening of the catch ring) of the through-opening for the catch ring 37. These cams 42 abut on the edges of the catch ring 37 in the locking position shown in FIGS. 9*a* and 9*b* and thus prevent a further (clockwise) rotation.

In the locking position of the rod assembly section 23 in the catch ring 37, longitudinal forces (in longitudinal direction of the rod assembly section axes) and a rotational torque (in FIGS. 9*a* to 10*b* clockwise) can be transferred to the entire drill rod assembly via the catch ring 37.

The center section 38 of each rod assembly section 23 has a reduced outer diameter in order to achieve a smaller (defined) bending stiffness relative to the end sections 39*a*, 39*b*. This is intended to enable the use of a controllable slanted drill head. By redirecting the drill head 43 in the soil, a drilling course which is arched in sections is achieved. The drill rod assembly 24 has to adjust to this arched drilling course which leads to a corresponding bending stress. The center section 38 of each rod assembly section 23 which has a reduced diameter and is thus relatively bending soft compared to the end sections 39*a*, 39*b*, serves for maintaining the rod assembly section 23 overall bending soft, however, at the same time serves for configuring the end sections 39*a*, 39*b* stiff which, due to the threads are particularly at risk of breaking.

Due to the arrangement of the combined linear/rotational drive 5 at the lower end of the pit section of the horizontal drilling device 1, and due to the smaller dimensions of the horizontal drilling device 1 (the housing 2 has a maximal diameter of about 60 cm) the individual rod assembly sections 23 cannot be manually fed to the linear/rotational drive 5. Rather, an automated rod assembly feed is provided for this purpose which is formed by a rod assembly receiver 44, which is arranged at the height of the linear/rotational drive 5 and the rod assembly lift 6.

The rod assembly receiver 44 is shown in the overall representation of FIGS. 4 and 5 and by itself in the representations of FIGS. 7*a*, 7*b*, 8*a* and 8*b*. The central element of the rod assembly receiver 44 is a receiving mandrel 45 which is supported in a bridge 46 which is connected to the two cylinder tubes 47 of two further hydraulic cylinders 48. The hydraulic cylinders 48 are also of the kind in which the piston rod 49 protrudes out of the cylinder tube 47 on both sides. The two free ends of the two piston rods 49 are connected to the housing 2 of the horizontal drilling device 1 so that by a corresponding impingement of the hydraulic cylinders 28 with hydraulic oil, the cylinder tubes 47 and thus the rod assembly receiver 44 can be displaced on the stationary piston rods 49 in horizontal direction.

Figure 7B:
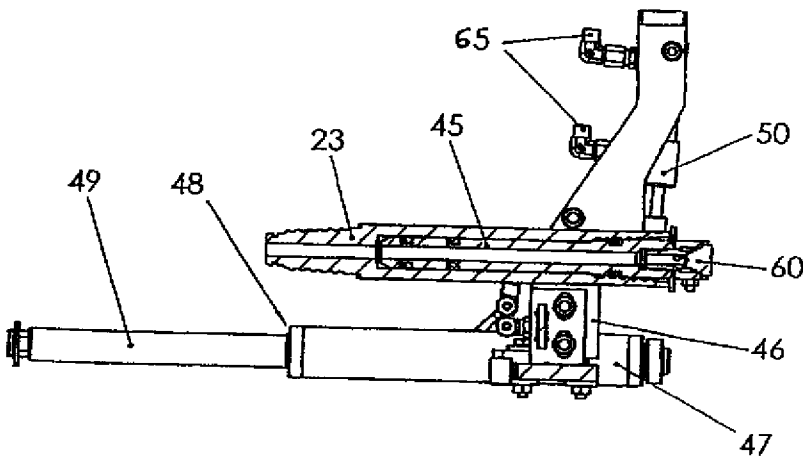
FIG. 7*b* an isolated representation of the rod assembly receiver of the horizontal drilling device in a first operating position in a sectional view.
Figure 7A:
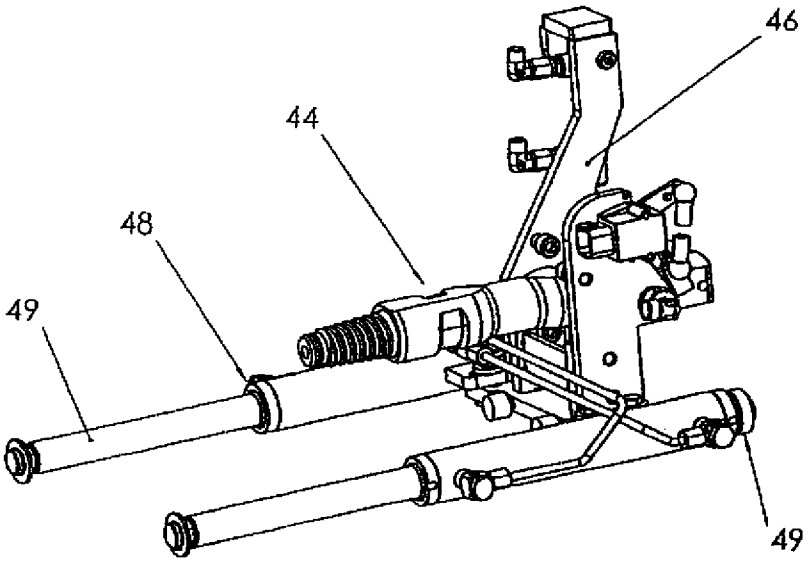
FIG. 7*a* an isolated representation of the rod assembly receiver of the horizontal drilling device in a first operating position in a perspective view.
Figure 8B:
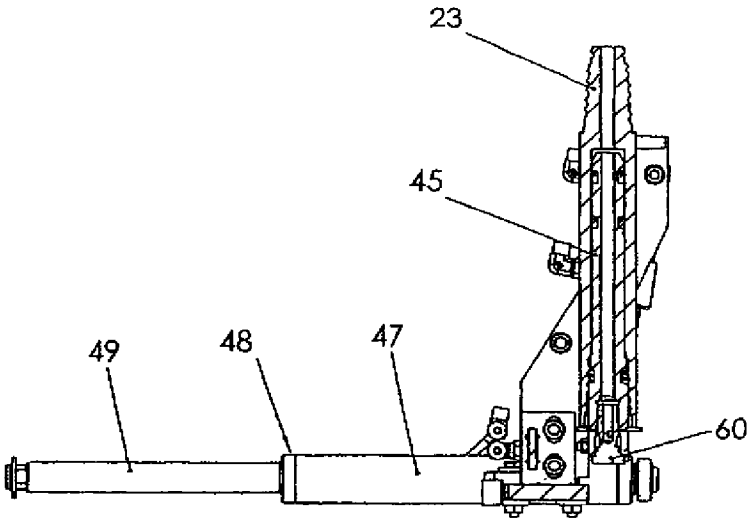
FIG. 8*b* an isolated representation of the rod assembly receiver of the horizontal drilling device in a second operating position in a sectional view.
Figure 8A:
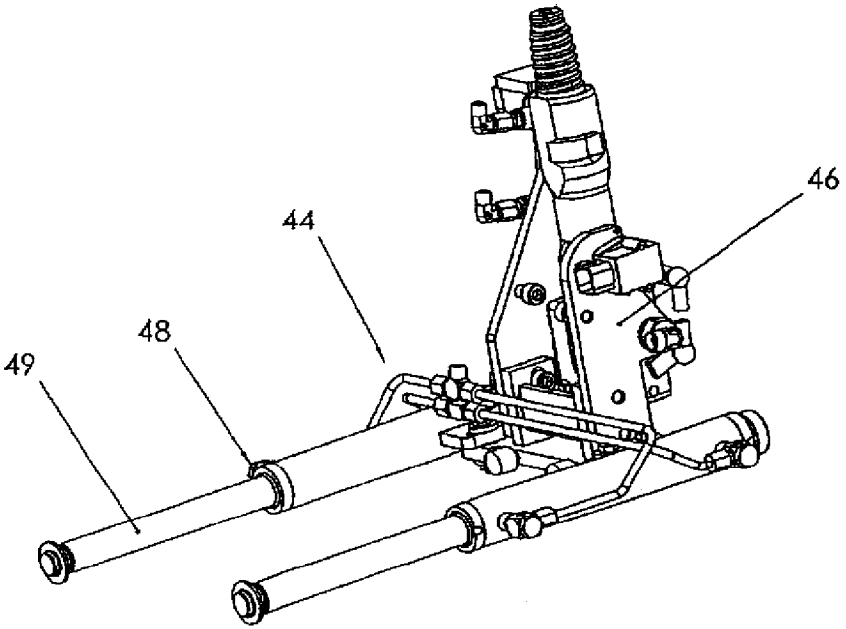
FIG. 8*a* an isolated representation of the rod assembly receiver of the horizontal drilling device in a second operating position in a perspective view.

The receiving mandrel 45 of the rod assembly receiver 44 is supported within the bridge 46 for pivoting about a horizontal axis, wherein a pivoting between the two end positions shown on one hand in FIGS. 7*a*, 7*b* and on the other hand 8*a*, 8*b* is possible. The pivoting is achieved via a further hydraulic cylinder 50 which is supplied with hydraulic oil via corresponding hydraulic connections 65.

In the orientation shown in FIGS. 7*a*, 7*b*, the longitudinal axis of the receiving mandrel 45 and a rod assembly section 23 attached onto the receiving mandrel 45 is coaxial to the drive sleeve 34 of the rotational drive and thus points in the drilling direction of the horizontal drilling device 1. In the vertical operating position shown in FIGS. 8*a*, 8*b* which is thus pivoted by 90° relative to the operating position according to FIGS. 7*a* and 7*b*, the receiving mandrel 45 and the rod assembly section 23 attached onto it are positioned within a guiding track 51 of the rod assembly lift 6. In this operating position of the receiving mandrel 45, a rod assembly section 23 can be attached onto the receiving mandrel 45 from the rod assembly lift 6 or removed from the latter.

Within the guiding track 51 of the rod assembly lift 6, a receiving sled 52 which can receive a rod assembly section 23, is movably guided, wherein the receiving sled 52 is fastened at a trumm of a drive belt 53 which extends outside of the guiding rail 51 and parallel to the latter. An upper driving roller of the driving belt 53 is connected to the motor (not shown) in order to drive the latter. A lower deflection roller 54 is supported on an axle 55 which is guided at both its ends on a threaded rod 56. By rotating the threaded rods 56, the vertical position of the lower deflection roller 54 can be changed so as to tension the driving belt 53. By means of the driving belt 53 the receiving sled 52 can be moved up and down in the guiding track 51. In this way a rod assembly section 23 which is inserted into a loading station 58 in the surface section of the horizontal drilling device 1 by operating personnel, can be transported to the rod assembly receiver 44 in the pit section—and vice versa.

Figure 11:
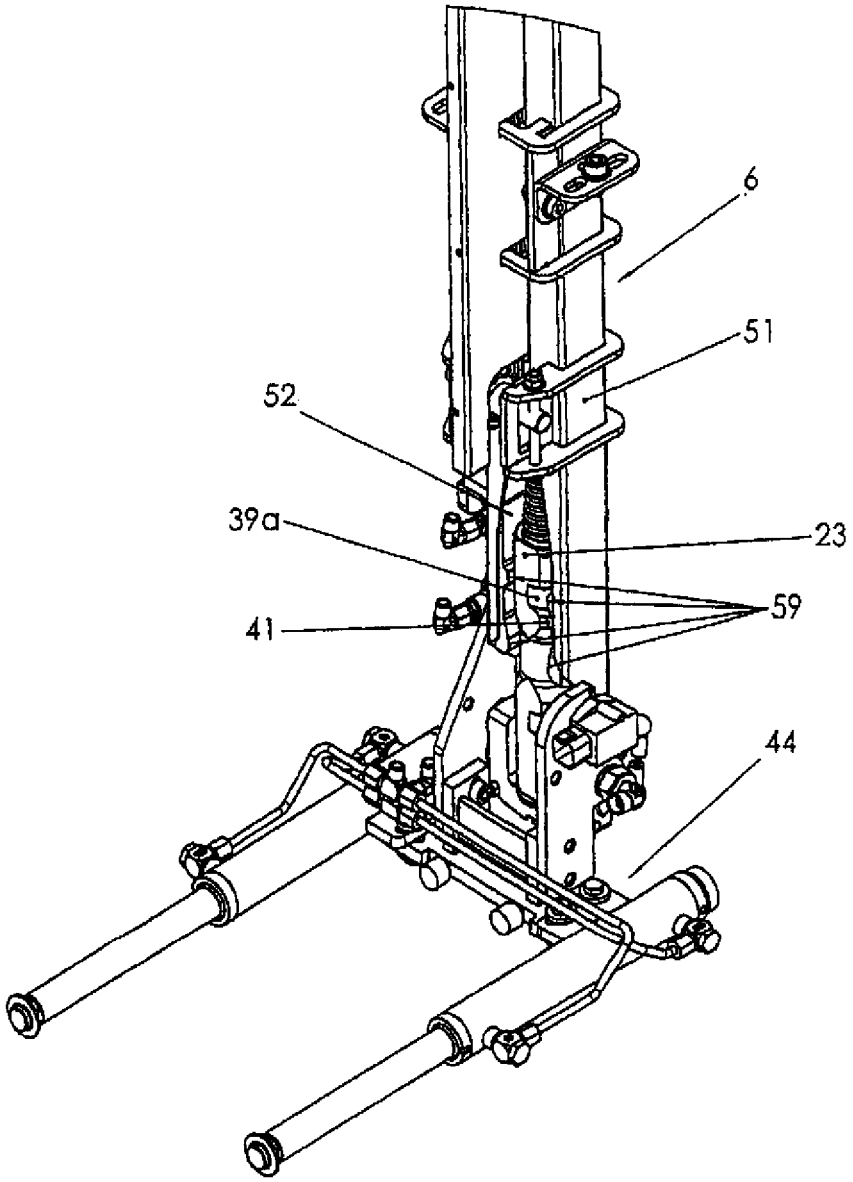
FIG. 11 an isolated representation of the rod assembly receiver and the lower section of the rod assembly lift in an isometric view.

FIG. 11 shows in an isolated representation of the rod assembly receiver 44 and the lower part of the rod assembly lift 6 including the receiving sled 52 in which a rod assembly section 23 is held. The receiving sled 52 forms a through-opening in which the rod assembly section 23 can be inserted from the side by the operating personnel in the region of the loading station 58. In the receiving sled 52 the inserted rod assembly section is supported suspensory, i.e., two pairs of projections 59 each form a free space which is only slightly broader than the diameter of the center section 38 and narrower than the broader side of the end sections 39*a*, 39*b* of the rod assembly section 23. One of the projection pairs engages into the locking grooves 41 of the front end section 39*a*, while the second projection pair engages in the center section 38 of the rod assembly section 23. Via the two projection pairs of the receiving sled 52, the rod assembly section 23 fixed therein is form fittingly held (in vertical and lateral direction). Of course it is also possible to use only one projection pair or only one single projection to hold the rod assembly section 23 within the receiving sled 52.

By lowering the receiving sled 52 within the guiding track 51 of the rod assembly lift 6, the rod assembly section 23 which is held in the receiving sled 52 is attached onto the vertically oriented receiving mandrel 45 (compare FIG. 5 [receiving sled not shown] and 8*a*, 8*b*) The receiving mandrel is then pivoted by 90° into the horizontal operating position shown in FIGS. 4 and 7*a*, 7*b*, whereby the rod assembly section 23 is pivoted in lateral direction out of the receiving sled 52. The receiving sled 52 can then be moved to the loading station 58 again so that a further rod assembly section 23 can be inserted.

The horizontal drilling device 1 is configured for carrying out flush drillings i.e., a drilling fluid is supplied via the rod assembly 24 to the drill head 43 which is arranged on the front side of the rod assembly 24, which drilling fluid exits through front side and lateral exit openings. To enable the supply of drilling fluid to the drill head 43, the individual rod assembly sections 23 of the drill rod assembly 24 are configured continuously hollow. The drilling fluid is supplied to the drill rod assembly 24 via the receiving mandrel 45 which for this purpose is also configured continuously hollow. Only on the rear side end i.e., the end which protrudes out of the attached rod assembly section 23, the receiving mandrel is closed by means of a screw cap 60. The drilling fluid is supplied to the inner space which is formed by the hollow receiving mandrel 45 via a shaft which is also configured hollow and on which the receiving mandrel is rotatingly supported. Two sealing rings on the outside of the receiving mandrel 45 prevent a leaking of the drilling fluid through the gap between the receiving mandrel 45 and the rod assembly section 23. This allows easily achieving a secure and constructively simple connection of the pivotal receiving mandrel 45 to the source of the drilling fluid. In contrast, a connection to the drilling fluid source while at the same time maintaining the pivotability of the receiving mandrel via flexible supply tubes requires more constructive effort, because the high pressure with which the drilling fluid is supplied to such a rod assembly 24 necessitates the use of extremely pressure resistant and with this poorly elastic supply tubes, which in turn would impede the pivoting movement of the receiving mandrel 45, which would require a greater and higher powered hydraulic cylinder 50 for the pivoting.

For generating a pilot bore, the horizontal drilling device 1 is used as follows.

Before lowering of the horizontal drilling device 1 into the excavation pit 4, the drill head 43 shown in FIG. 1 is inserted into the drive sleeve 34 of the rotational drive through a through-opening 61 for the drill rod assembly which through-opening 61 is formed in the housing 2. This is necessary because the drill head has an integrated transmitter for localization by means of a so called walk-over-receiver and is therefore longer than the rod assembly sections 23. The drill head has a (rear) end section 62 which corresponds to the end sections 39*a*, 39*b* of the rod assembly sections 23 with regard to the geometric shape: Two arch-shaped locking grooves are introduced into the end section 62 with a cylindrical basic shape which is provided with parallel flat portions on two opposing sides, into which grooves the catch ring 37 can be rotated by a 90° clockwise rotation, whereby the drill head 43 is locked in the rotational drive. The rotational drive is located in the rear most position in which the latter can be driven as far as possible away from the through-opening 61 by means of the linear drive.

The horizontal drilling device 1 is then lowered into the excavation pit 4, oriented and supported, as already described.

By using the linear/rotational drive 5 the drill head is then drilled into the soil as far as possible. Due to the length of the drill head 43 the drilling occurs with two strokes of the linear drive; in the first stroke the catch ring 37 is located at the front end of the two parallel flat portions so that the pressure forces are transferred over the protrusion formed there, and the rotational torque is transferred via the parallel flat portions which serve as wrench flats. After the first stroke, the linear drive is retracted so that the catch ring 37 can engage in the locking grooves and lock the drill head 43. After this, the linear drive is moved forward again, whereby the drill head 43 is completely drilled in. The rotational drive is then located in the front most position shown for example in FIGS. 4 and 5. A locking fork (not shown) provided in the region of the through-opening is then lowered. The fork width of the locking fork corresponds to the distance of the two parallel flat portions of the drill head 43 and the distance of the two locking grooves. Previously, the drill head 43 was oriented by means of the rotational drive so that the two flat portions of the end section are oriented vertically so that the locking fork can travel over the end section (in a section before the locking grooves) of the drill head 43, thereby temporarily preventing a rotation of the drill head 43 by means of a form fitting fixing.

During the advancement of the drill head 43 into the soil, a first rod assembly section 23 was already inserted into the receiving sled 52 by an operating person and by displacing the rod assembly lift 6 attached onto the receiving mandrel 45. After pivoting of the receiving mandrel 45 and the rod assembly section attached thereto, by 90° into its horizontal orientation, the rod assembly section 23 is in a predominantly coaxial position relative to the already drilled drill head 43. By displacing the two hydraulic cylinders 48 of the rod assembly receiver 44, the front side of the threaded plug of the rod assembly section 23 can be driven to the rear side threaded socket of the drill head 43. The catch ring 37 is then released from the locking grooves of the drill head 43 and the linear/rotational drive 5 retracted until it is located in a defined region of the front end section 39*a* of the first rod assembly section 23. By actuating the rotational drive, the first rod assembly section 23 is screwed together with the drill head 43 which is fixed in rotational direction by the locking fork, wherein the rotational torque is transferred via the parallel flat portions 40. Due to the fact that the catch ring 37 is not yet locked in the locking groove 41, the rod assembly section can move in axial direction relative to the catch ring 37 during screwing. This allows realizing the longitudinal movement of the rod assembly section 23 which is necessary for the screwing of the rod assembly section 23 without an elaborate length compensation which is realized by the linear drive.

The position of the rotational drive during the screwing is chosen so that the locking grooves 41 of the front end section 39*a* are located within the catch ring 43 after the rod assembly section 23 is completely screwed together with the drill head 43 so that the catch ring 37, after a rotation of 90°, can engage directly i.e., without necessitating a further displacement of the linear drive, in the locking grooves 41 to fix the rod assembly section 23 also in longitudinal direction. The drill rod string is then drilled until the rotational drive reaches its front end-position again.

After this, the rotational drive is unlocked by a 90° rotation (in the opposite direction) of the catch ring and retracted by means of the hydraulic cylinder 25 of the linear drive until the catch ring 37 can engage in the locking grooves 41 of the rear end section 39*b* of the first rod assembly section 23; there, the catch ring 37 is locked again by a 90° rotation. Then, the drill rod string composed of the drill head 43 and the first rod assembly section 23, is advanced into the soil by a further working stroke of the linear drive by using the linear/rotational drive.

As soon as the rotational drive has reached its front end position, the rod assembly receiver 44 is moved back into the rear position and the receiving mandrel 45 is pivoted into the vertical position where the latter can receive a second rod assembly section 23 which was already inserted into the receiving sled 52 by the operating personnel which receiving sled 52 was moved into the loading station 58.

After finishing the working stroke of the linear drive, the locking grooves of the front end section 39*a* of the first rod assembly section 23 are located below the locking fork which can then be lowered to fix the drill rod string, while the second rod assembly section 23 is screwed to the existing drill rod string. For this, the second rod assembly section 23 is moved to the rear end of the first rod assembly section 23 by means of the rod assembly receiver 44. At the same time, the rotational drive is released from the first rod assembly section 23 and moved backwards until it can engage on the parallel flat portions 40 in the front end section 39*a* of the second rod assembly section 23. By using the linear/rotational drive 5, the second rod assembly section 23 is then screwed to the first rod assembly section 23, wherein after finishing the screwing, the catch ring 37 locks again in the locking grooves 41 of the front end section 39*a* of the second rod assembly section and the drill rod string is drilled until reaching the front end position (of the linear drive) again. The linear/rotational drive 5 is then released from the second rod assembly section 23 by a 90° relative rotation of the catch ring 37 and moved backwards again to lock the second rod assembly section 23 in the rear end section 39*b* and to advance the drill rod string into the soil again by a further working stroke.

In contrast to the drill head 43, the locking fork engages in the locking grooves 41 of the rod assembly sections 23 to lock the latter not only rotatively but also against a movement in longitudinal direction. This allows preventing the drill rod string from unintentionally becoming displaced due to elastic re-deformation of the compressed soil and the drill rod assembly which has been compressed or stretched by the loads.

The attachment and drilling of further rod assembly sections 23 occurs in an identical manner.

After the pilot bore is complete, the drill head 43 can be replaced by a widening device (not shown) to widen the bore during retraction of the drill rod assembly. Optionally, a new pipe (not shown) or another supply line (not shown) can be attached to the widening head which is drawn into the bore simultaneous with the widening device.

When retracting the drill rod assembly 24, the latter is shortened step by step by one rod assembly section 23 at a time. This occurs in the following manner.

The catch ring 37 of the rotational drive is locked in the locking grooves 41 of the rear end section 39*b* of the last rod assembly section 23. The rotational drive is moved backwards by displacing the hydraulic cylinders 25 of the linear drive. The locking fork is then lowered and fixes the second to last rod assembly section 23 by engaging of the locking fork in the rear end section 39*b* of this rod assembly section 23. The linear/rotational drive 5 is then released from the rod assembly section 23 by a 90° rotation of the catch ring and moved forward again until the catch ring 37 can engage in the locking grooves of the front end section 39*a* of the last rod assembly section 23. By a further working stroke of the linear drive the drill rod assembly 24 is pulled out of the soil as far as to enable the locking fork to lock the second to last rod assembly section 23 in the front end section 39*a*. Then, the last rod assembly section 23 can be screwed off from the second to last rod assembly section 23 by a counter clockwise rotation of the drive sleeve 34. Due to the particular shape of the rod assembly section in the region of the end sections, a rotational torque can be transferred for releasing the threaded connection without the catch ring 37 being fixed in the locking groove 41 also in longitudinal direction. This allows the catch ring 37 to slide over the rod assembly section according to the thread pitch, which allows avoiding a length compensation via the linear drive. Simultaneously, the rod assembly receiver 44 moves forward to receive the unscrewed last rod assembly section 23. The rod assembly receiver 44 then moves to its rear most position again and the linear/rotational drive 5 moves simultaneously forward so that the latter can engage on the rear end section 39*b* of the then last (before second to last) rod assembly section 23. The screwed-off rod assembly section 23 is then completely moved out of the drive sleeve 34 and can be inserted into the receiving sled 52 of the rod assembly lift 6 by pivoting of the receiving mandrel 45 into the vertical position. The receiving sled 52 can then be moved upwards to the loading station 58 where the rod assembly section can be retrieved by an operating person.

In the same manner, all rod assembly sections are successively released from the horizontal drilling device.

The shown horizontal drilling device is appropriate for use in non-urban environments and in particular for the generation of house connections in the supply field (in particular gas, water, electricity, fiber glass, etc). Bores of at least 20 m in length can be introduced which are then used for drawing in pipes or cables with an outer diameter of up to 63 mm.

What is claimed is:

1. A method for generating a horizontal bore in the ground comprising the steps of:

generating an excavation pit having a circular cross section;

lowering a horizontal drilling device, including a linear drive for driving a rod assembly, into the excavation pit, wherein the horizontal drilling device includes a housing surrounding the linear drive, the housing being configured at least partially cylindrical in section at least a section in which the housing is arranged within the excavation pit in an operation condition of the horizontal drilling device;

suspending the horizontal drilling device within the excavation pit by at least one support device comprising a plurality of support legs arranged on a surface of the ground and coupled to a section of the housing arranged above a surface of the ground, the plurality of support legs extending radially outward from the housing and substantially symmetrically around the excavation pit to support the horizontal drilling device; and generating the horizontal bore with the horizontal drilling device.

2. The method of claim 1, wherein the excavation pit is generated so as to have a diameter of <85 cm.

3. The method of claim 1, wherein the excavation pit is generated so as to have a diameter of <60 cm.

4. The method of claim 1, wherein the excavation pit is generated by drilling open a surface seal with a crown drill and/or by sucking away the soil.

5. A horizontal drilling device comprising:

a linear drive;

a rod assembly which is drivable into the soil by the linear drive;

a housing surrounding the linear drive, said housing being configured at least partially cylindrical in at least a section in which the housing is arranged within an excavation pit in an operation condition of the horizontal drilling device; and at least one support device comprising a plurality of support legs arranged on a surface of the ground and coupled to a section of the housing arranged above a surface of the ground for suspending the horizontal drilling device within the excavation pit, wherein the plurality of support legs extend radially outward from the housing and substantially symmetrically around the excavation pit to support the horizontal drilling device.

6. The horizontal drilling device of claim 5, wherein the housing forms a substantially closed sheath in said section.

7. The horizontal drilling device of claim 6, further comprising at least one support element which is displaceable radially over an outer circumference of the housing to support the horizontal drilling device on a wall of the excavation pit.

8. The horizontal drilling device of claim 7, further comprising at least two of said support element distributed along the outer circumference of the housing and being displaceable individually or jointly.

9. The horizontal drilling device of claim 8, wherein each of the support elements has a support plate which forms a part of the sheath.

10. The horizontal drilling device of claim 7, further comprising from three to five of said support element.

11. The horizontal drilling device of claim 5, wherein another section of the housing is arranged above the excavation pit in the operating condition.

12. The horizontal drilling device of claim 5, wherein the at least one support device is configured adjustable, to enable a height positioning of the horizontal drilling device in the excavation pit.

13. The horizontal drilling device of claim 5, further comprising a rod assembly lift for transporting a rod assembly section of the rod assembly between the section of the housing arranged above the excavation pit and the section prior to being received by the linear drive.

14. The horizontal drilling device of claim 13, wherein the rod assembly lift has a rod assembly receiver into which the rod assembly section is laterally insertable though an opening formed in the section of the housing arranged above the excavation pit.

15. The horizontal drilling device of claim 13, further comprising a receiving mandrel arranged in a region of the linear drive, wherein the rod assembly section is attachable to the receiving mandrel by the rod assembly lift.

16. The horizontal drilling device of claim 15, wherein the receiving mandrel is pivotal from a substantially vertical transport position into a substantially horizontal drilling position.

* * * * *